US006302666B1

(12) United States Patent
Grupping

(10) Patent No.: US 6,302,666 B1
(45) Date of Patent: Oct. 16, 2001

(54) DOWNHOLE ROLLER VANE MOTOR

(76) Inventor: Arnold W. J. Grupping, Anjelierenlaan 3, 2111 BP Aerdenhout (NL)

( * ) Notice: Subject to any disclaimer, the term of this patent is extended or adjusted under 35 U.S.C. 154(b) by 0 days.

(21) Appl. No.: 09/552,975

(22) Filed: Apr. 20, 2000

Related U.S. Application Data

(63) Continuation of application No. PCT/NL98/00598, filed on Oct. 19, 1998.

(30) Foreign Application Priority Data

Oct. 21, 1997 (NL) ..... 1007327
Oct. 30, 1997 (NL) ..... 1007405
Nov. 25, 1997 (NL) ..... 1007613

(51) Int. Cl.[7] ..... F03C 2/22
(52) U.S. Cl. ..... 418/188; 418/225
(58) Field of Search ..... 418/188, 225

(56) References Cited

U.S. PATENT DOCUMENTS 1,790,460 1/1931 Capeliuschnicoff ..... 175/107
3,207,079 * 9/1965 Cook et al. ..... 418/225
4,105,377 8/1978 Mayall ..... 418/225
4,486,150 * 12/1984 Davis ..... 418/225
4,692,105 * 9/1987 Leroy ..... 418/225
5,460,496 * 10/1995 Van-Drentham Susman ..... 418/225
5,518,379 5/1996 Harris et al. ..... 418/225
5,733,113 * 3/1998 Grupping ..... 418/225

FOREIGN PATENT DOCUMENTS 1 054 822A 11/1967 (GB) .

* cited by examiner

*Primary Examiner*—John J. Vrablik
(74) *Attorney, Agent, or Firm*—Hoffmann & Baron, LLP

(57) ABSTRACT

A roller vane motor for downhole drilling comprises a housing (1) and a rotor (2). The housing contains wing deflector cams (5) that divide the space between housing and rotor into chambers (8*a, b*). The rotor is equipped with cylindrical rollers (7) in recesses (6), which rollers can move between an extended and a retracted position. Drilling fluid enters the chamber parts (8*a*) through inlet ports (10) in the upper bearing part of the housing (1) and pushes rollers ($7^1$) into their extended position and in a clockwise direction, making the rotor turn, whilst drilling fluid of lower pressure is pushed from the corresponding chamber parts (8*b*) through outlet ports (9) in the lower bearing part of the housing (1) and further to the drill bit below. When the rollers ($7^1$) reach the wing deflector cams (5) they are forced into the retracted position, their task being taken over by rollers ($7^2$).

2 Claims, 6 Drawing Sheets

DOWNHOLE ROLLER VANE MOTOR

CROSS-REFERENCE TO RELATED APPLICATIONS

This is a continuation application of PCT/NL98/00598 filed on Oct. 19, 1998.

FIELD OF THE INVENTION

The invention relates to a hydraulically or pneumatically driven roller vane motor for vertical, directional and horizontal drilling and well cleaning/repairing, to a roller vane production motor for driving a downhole rotating pump and to a roller vane pump, suitable for pumping oil and/or water from a subterranean reservoir or for pumping up water from a surface reservoir.

BACKGROUND OF THE INVENTION

To drive drill bits, it is known to use downhole roller vane motors. These motors are driven by the drilling mud that is pumped down through the drill string to lubricate and cool the bit and to carry drill cuttings back to the ground surface through the annular space between the drill string and the borehole wall.

Roller vane motors with inner and outer housing and with the inlet/outlet ports in the inner housing are described in WO 93/08374. Roller vane motors with combined inner and outer housing, with inlet ports in the rotor and outlet ports in the housing are described in WO 94/16198.

In the above motors, rollers that are located in the extended position in recesses in the rotor are pushed by the drilling mud in chambers between rotor and (inner) housing from inlet ports towards outlet ports in a clockwise direction. Rollers that are not pushed by the drilling mud towards an outlet port are not subjected to the mud pressure since they have been forced into a retracted position by longitudinally extending wing deflector cams along the inner wall surface of the (inner) housing.

Advantages of the known roller vane motor with combined inner and outer housing compared to the roller vane motor with both inner and outer housing are its simpler construction and the greater torque per unit length of the motor.

A drawback of the known roller vane motor with combined inner and outer housing is that the pressure drop across the motor must be equal to the pressure drop across the drill bit, since these pressure drops are parallel. Moreover, the flowrate of the drilling mud across the drill bit is reduced.

SUMMARY OF THE INVENTION

The present invention provides various embodiments of roller vane motors that overcome the drawback mentioned above. To this end, the present invention provides a roller vane motor driven by mud for drilling or coring, the roller vane motor being adapted for use as a production motor to drive a downhole rotating pump and a special roller vane motor for use as a drilling motor with an outer jacket.

The present invention will be elucidated below in more detail with reference to the drawings.

Favourable embodiments of these roller vane motors and pumps are described in the sub-claims related thereto. Finally, the present invention provides a method and system for the use of such pumps. The present invention will be elucidated below in more detail with reference to the drawings.

DESCRIPTION OF THE PREFERRED EMBODIMENTS

Figure 1:
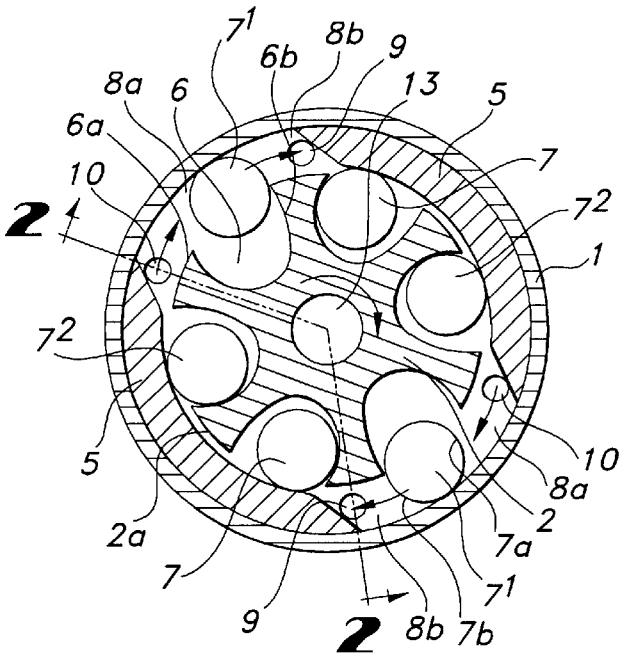
FIG. 1 is a transverse sectional view from above of a roller vane motor with combined inner/outer housing according to the invention.
Figure 2:
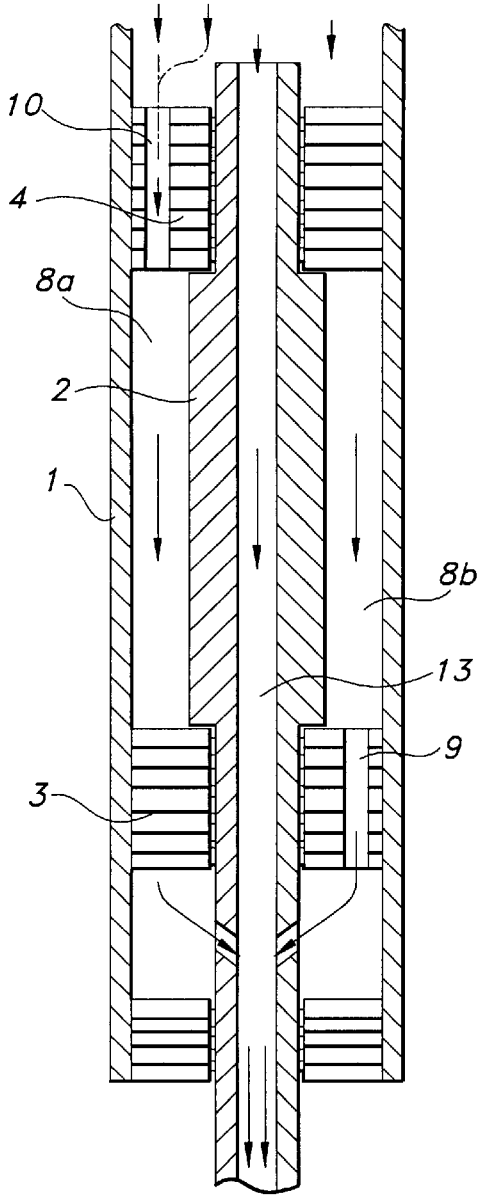
FIG. 2 is a schematic longitudinal side view of the motor of FIG. 1.

In the roller vane motor with combined inner and outer housing according to the invention, the drawback of parallel pressure drop across the motor and the drill bit is eliminated by locating the inlet and outlet ports in the upper and lower bearing part of the housing instead of in the rotor and in the housing, as shown in FIGS. 1 and 2. The roller vane motor in these figures comprises a tubular housing 1 and a rotor 2 running in bearing parts 3 and 4 at either end of said housing 1. The housing 1 is connected at its upper end to a non-rotating drill string. The housing 1 is provided with two radially inwardly projecting wall means in the form of longitudinally extending wing deflector cams 5 which, together with said housing 1, form a stator for the roller vane motor. The wing deflector cams 5 together occupy about half the circumference of the housing 1 and have a rising part that runs from the housing 1 towards the concentric part of the wing deflector cam 5 and a falling part that does the reverse. The rotor 2 is connected at its lower end to a drill bit. The rotor 2 is provided at its circumference with three pairs of diametrically opposed and circumferentially spaced slots in the form of round bottomed recesses 6, in which are disposed elongate longitudinally extending wings in the form of cylindrical rollers 7. The rollers 7 are movable between a retracted position in which they are fully or largely contained within the recesses 6 and a radially projecting position in which they partly project from the outer surface 2*a* of the rotor 2. Each roller is preferably made of metal, of a resiliently deformable acid- and heat-resistant plastic material, or consists of a metal core with a shell of said plastic material. A generally annular space, defined between the rotor 2 and the housing 1, is divided by the two wing deflector cams 5 into chambers 8*a, b*. Said chambers 8*a, b* are connected to outlet ports 9 in the lower bearing part 3 of the housing 1 for the passage of drilling mud therethrough to the drill bit, said outlet ports 9 being positioned at or near the rising part of the wing deflector cams 5. The upper bearing part 4 of the housing 1 is provided with inlet ports 10 for the passage of drilling mud therethrough from the drill pipe above to each of the chambers 8*a, b*, said inlet ports 10 being positioned at or near the falling part of the wing deflector cams 5.

Because the pressure of the drilling mud that enters the chambers 8*a, b* through the inlet ports 10 is higher than the pressure of the drilling mud that leaves the chambers 8*a, b* through the outlet ports 9, the rollers $7^1$ that are positioned in the chambers 8*a, b* are sucked outward and pressed against the space between the downstream sides 6*b* of the recesses 6 in the rotor 2 and the housing 1, thereby dividing the chambers 8*a, b* into high-pressure parts 8*a* and lower-pressure parts 8*b*. The rollers $7^1$ are thus exposed to high-pressure drilling mud at their upstream side 7*a*, entering through the inlet ports 10, thereby exerting a clockwise turning moment on the rotor 2. Two other pairs of rollers are pressed down into their retracted position in the recesses 6 in the rotor 2 by the wing deflector cams 5. When the rotor 2 has turned approximately 30 degrees further in the clockwise direction under the influence of the mud pressure on the first mentioned rollers $7^1$ in the chamber parts 8*a*, the retracted rollers $7^2$ will clear the wing deflector cams 5 and be resiliently restored into their projecting position with their upstream side 7*a* exposed to the pressure of the drilling mud entering through the inlet ports 10 in the upper bearing part 4, thereby ensuring a continuous driving and rotating force on the rotor 2 with a torque substantially directly proportional to the pressure difference in the drilling mud between the upstream chamber parts 8*a* and the downstream chamber parts 8*b*. The drilling mud in the chamber parts 8*b* is compressed between the advancing downstream sides 7*b* of the rollers $7^1$ and the respective opposing wing deflector cams 5 and is expelled through the outlet ports 9 in the lower bearing part 3 back to a central conduit 13 in the rotor 2 and mixes with another part of the drilling mud that flows through this central conduit 13 directly to the drill bit. It will of course be appreciated that the rollers 7 will in practice tend to roll as the rotor 2 turns, thereby passing over any particular matter trapped between the rollers 7 and the housing 1 or the wing deflector cams 5 without damage thereto. The central conduit 13 in the rotor 2 may be provided with a regulator, to regulate the relative amounts of drilling mud that pass to the drill bit through the chambers 8*a, b* of the rotor and through said central conduit 13 in the rotor 2.

Figure 3:
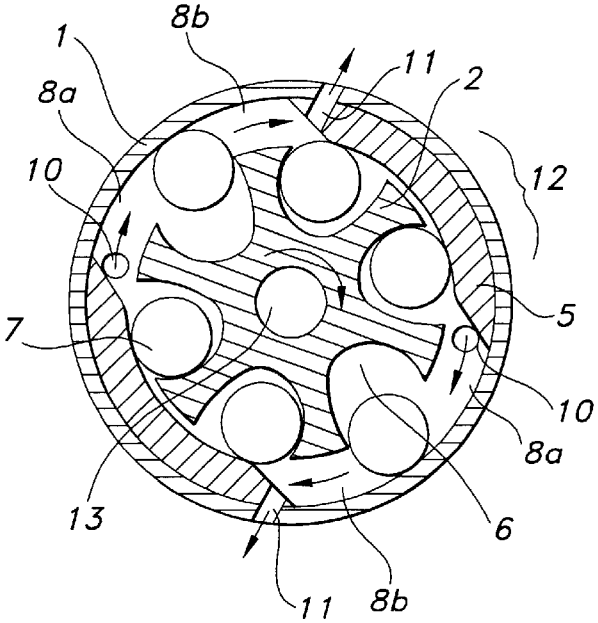
FIGS. 3 and 4 are transverse sectional views from above of other embodiments of the roller vane motor of FIG. 1.

In the embodiment shown in FIG. 3 the outlet ports 9 have been replaced by outlet ports 11 in the housing 1 and the rising part of the wing deflector cams 5, said outlet ports 11 connecting the chamber parts 8*b* with the annular space 12 outside the housing 1.

Figure 4:
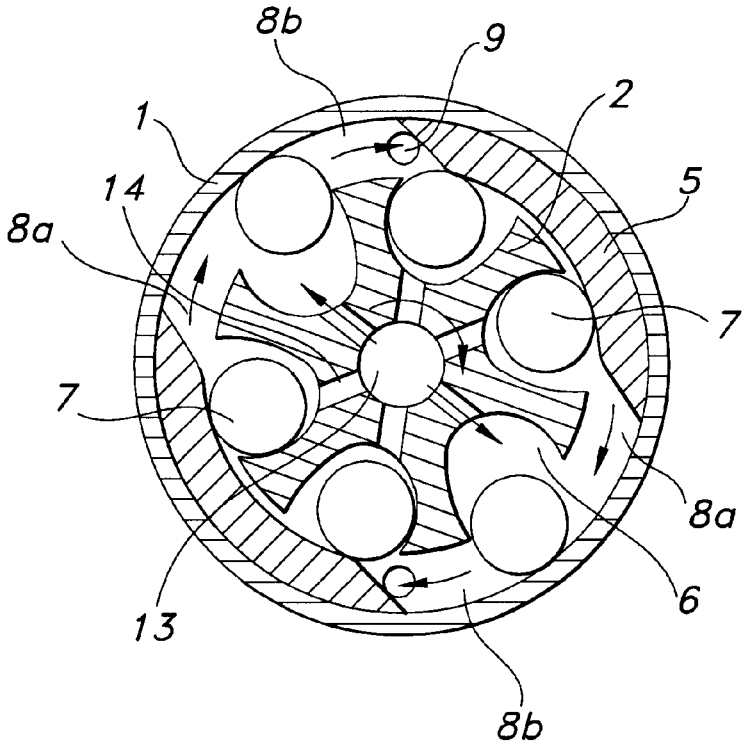

In the embodiment shown in FIG. 4 the inlet ports 10 have been replaced by inlet ports 14 in the rotor 2, said inlet ports 14 connecting the central conduit 13 in the rotor 2 with the bottoms of the recesses 6.

In all the above motors, the number of wing deflector cams 5 may be larger than two, spaced at equal distance along the interior wall surface of the housing 1, and the number of recesses 6 in the rotor 2 with matching rollers 7 may be smaller or larger than six. Preferably, however, the number of rollers 7 should be at least one larger than the number of wing deflector cams 5 and preferably less than twice as large. It will be appreciated that the corners of the rising and falling part of the wing deflector cams 5 may be rounded off and that their slope should be as flat as possible, to bring about a smooth movement of rollers 7 between their retracted and extended position and vice versa. The flatness of these slopes is limited by the requirement that short-circuiting of the flow of drilling mud between inlet and outlet ports must be avoided, both in the chambers 8*a, b* and in the area between the concentric part of the wing deflector cams 5 and the rotor 2. The inner wall sections of the housing 1 and the concentric section of the wing deflector cams 5 must therefore each have a certain minimum width.

Figure 5:
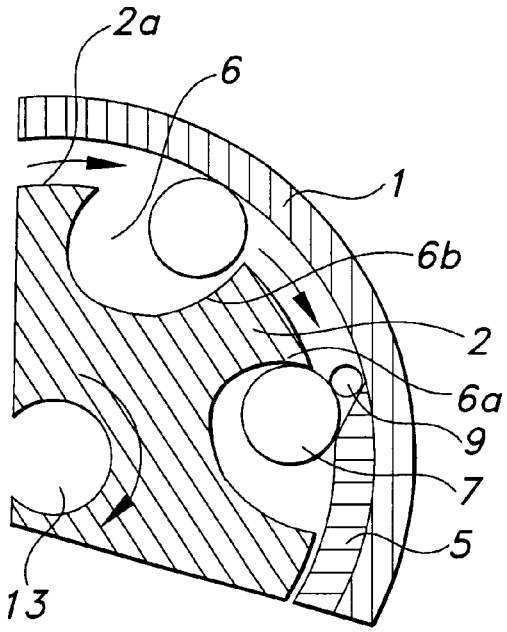
FIG. 5 is a transverse sectional view from above of part of the roller vane motor of FIG. 1, showing two special configurations.

When travelling in their extended position on the inner wall surface of the housing 1, rollers 7 are pressed against the space between said inner wall surface and the outer surface 2*a* of the rotor 2. To avoid pinching of rollers 7 between said inner wall surface of the housing 1 and the downstream leading sides 6*b* of the recesses 6 in the rotor 2, it is advantageous to shape these downstream sides 6*b* such that rollers 7 are in contact with them at the outer surface 2*a* of the rotor 2. Likewise, to avoid pinching of rollers 7 between the rising part of the wing deflector cams 5 and the upstream trailing sides 6*a* of the recesses 6 in the rotor 2, it is advantageous to shape said trailing upstream sides 6*a* such that rollers 7 on said rising part are in contact with said upstream sides 6*a* at the outer surface 2*a* of the rotor 2. Both configurations are illustrated in FIG. 5. Also, the diameter of the rollers 7 should be larger than twice the distance between the inner surface of the housing 1 and the outer surface of the rotor 2.

Figure 6:
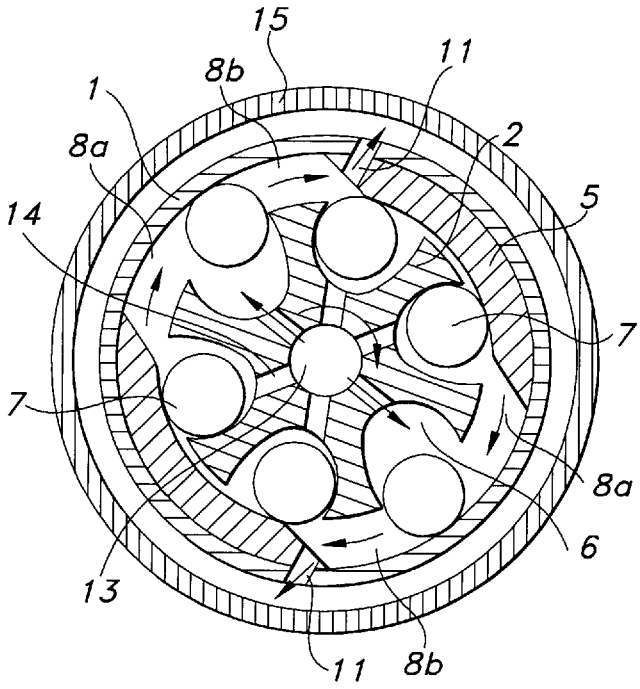
FIG. 6 is a transverse sectional view from above of a roller vane motor for use as a drilling motor with outer jacket.
Figure 7:
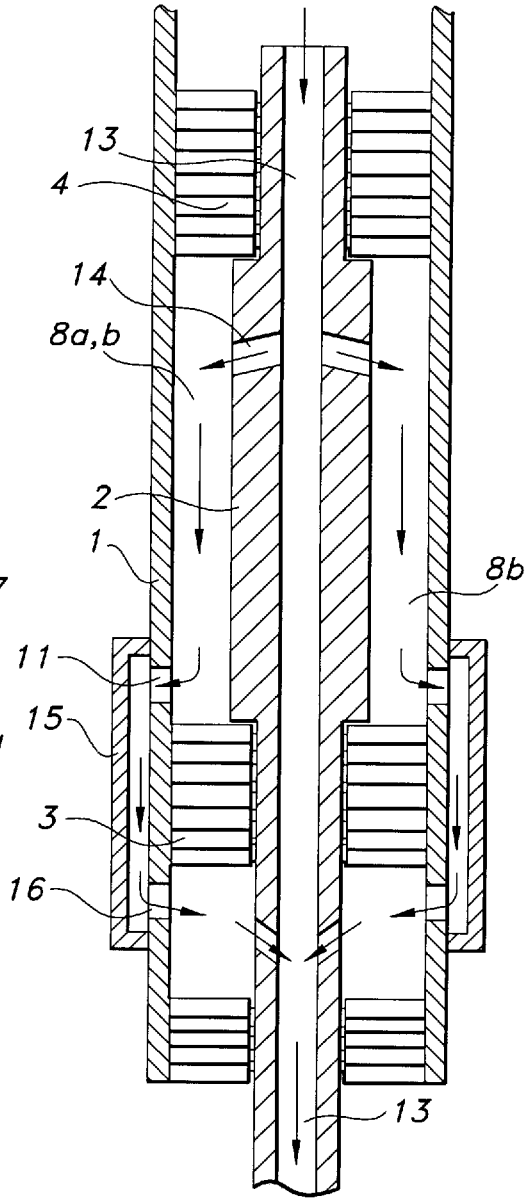
FIG. 7 is a schematic longitudinal side view of the motor of FIG. 6.

In the embodiments shown in FIG. 6 and FIG. 7 the outlet ports 11 are located in the housing 1 and the rising part of the wing deflector cams 5. These outlet ports 11 connect the chamber parts 8*b* with an annular space between the housing 1 and an outer jacket 15, attached to said housing 1. Via this annular space the drilling mud returns through inlet ports 16 to the space inside the housing 1 and further via the central conduit 13 in the rotor 2 to the drill bit.

It will be appreciated that a continuous central conduit 13 in the rotor 2 is only required for drilling motors if the amount of drilling mud required for the drill bit is larger than the amount required to drive the motor. If this is not the case, the central conduit 13 can be omitted or blocked somewhere half-way down the motor.

It will be appreciated that the motors may not only be used for drilling or coring purposes, but also to repair and clean boreholes. Thus, the working fluid need not exclusively be drilling mud but can also consist of other liquids such as e.g. oil or water, of a gas/liquid mixture, or a gas such as e.g. air.

Roller vane motors for drilling purposes as described above can also be used as a production motor for driving a rotating pump to produce fluids from a subterranean reservoir to the ground surface. At its upstream side the housing 1 of the production motor is then attached to a power fluid supply tube that is connected with the ground surface. At its lower side the housing 1 and the rotor 2 are attached to the housing and rotor of a rotating pump. Power fluid and produced fluids from a subterranean reservoir are mixed and pumped to the ground surface together through the annulus outside the power fluid supply tube or through a production tube parallel with or concentric around the power fluid supply tube. In the embodiments in which the power fluid leaves the production motor inside the housing of the motor, provisions must be made to lead this power fluid back to the annular space 12 outside the motor. In the embodiments in which a central conduit 13 is present in the rotor 2, this central conduit 13 must be closed of or omitted.

Figure 8:
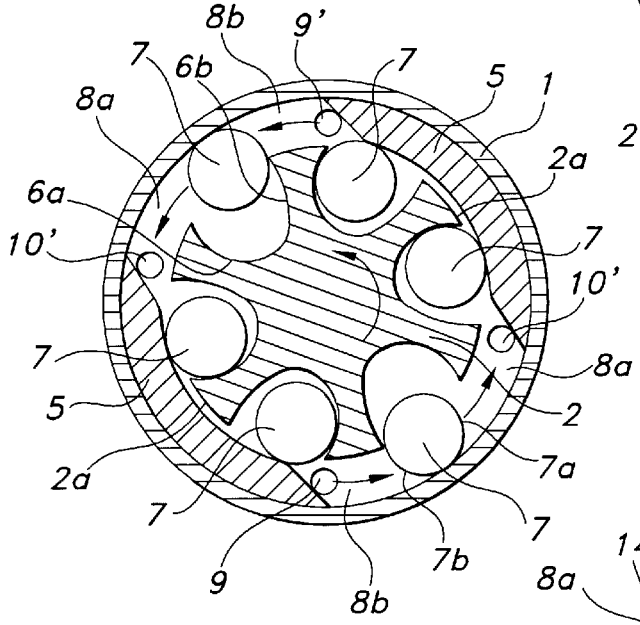

Roller vane motors as described above can also be used as roller vane pumps. To this end, the rotor 2 must be attached to and driven by a downhole electromotor in a direction opposite to that of the described motor. Where present, a central conduit 13 in the rotor 2 must be closed off or omitted. An example of a pump with axial fluid inlet and axial fluid discharge is shown in FIG. 8. The construction of this pump is similar to that of the motor shown in FIG. 1, with the exception that the central conduit 13 in the rotor 2 has been omitted. Fluid is sucked in from the inside of the housing 1 below the pump through outlet ports 9 in the lower bearing part 3, that then become inlet ports 9', and is pumped by the rollers 7 via the chambers 8*a, b* and the inlet ports 10 in the upper bearing part 4, that then become outlet ports 10', to production tubing above the pump and further to the ground surface. The rotation direction of the pump is shown with a curved arrow.

Figure 9:
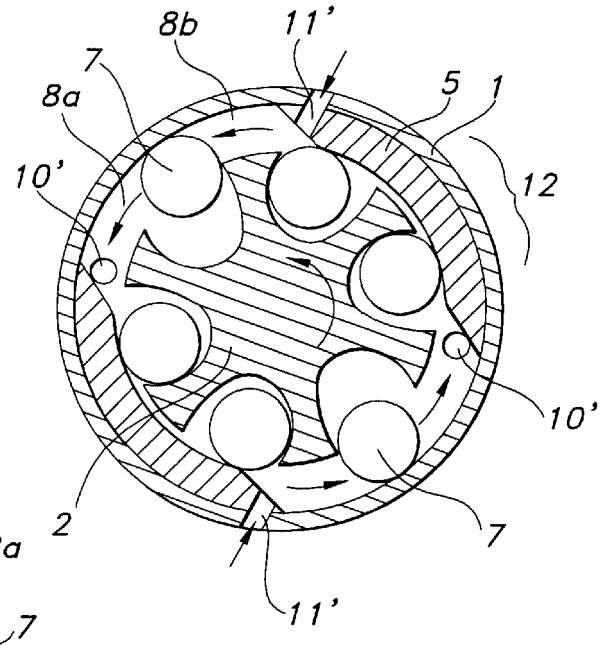
FIGS. 8, 9, 10 and 11 are transverse sectional views from above of roller vane pumps according to the present invention.

Another example of a roller vane pump is shown in FIG. 9. The construction of this pump is similar to that of the motor shown in FIG. 3, with the exception of the central conduit 13 in the rotor 2 which has been omitted. In this pump the outlet ports 11 to the annulus 12 outside the housing 1 become inlet ports 11' and the inlet ports 10 in the upper bearing part 4 become outlet ports 10'.

Figure 10:
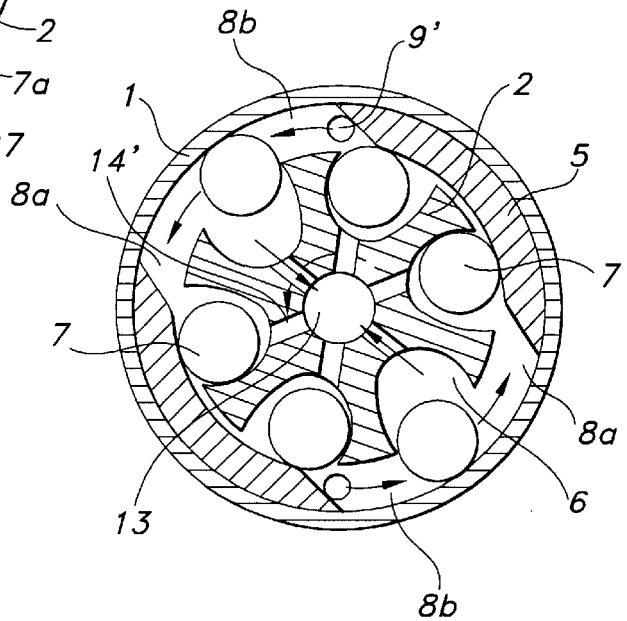

Yet another example of a roller vane pump is shown in FIG. 10. The construction of this pump is similar to that of the motor shown in FIG. 4. In this pump the outlet ports 9 in the lower bearing part 3 of the housing 1 become inlet ports 9' and the inlet ports 14 in the rotor 2 become outlet ports 14'. The lower end of the central conduit 13 in the rotor 2 must be closed of in this embodiment.

Figure 11:
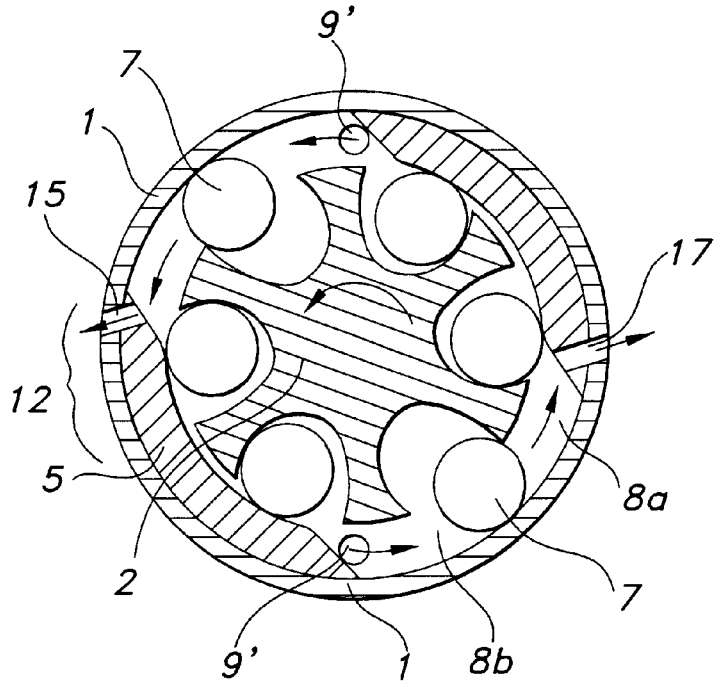

Roller vane pumps can also be driven by a roller vane production motor. In that case, it is advantageous to use a pump with axial fluid inlet and fluid discharge to the annulus 12 outside the housing 1, as shown in FIG. 11. In this embodiment, fluid is sucked in through the inlet ports 9' in the lower bearing part 3 of the housing 1 and is pumped by the rollers 7 via the chambers 8*a, b* and outlet ports 17 in the housing 1 and the rising part of the wing deflector cams 5 to the annulus 12 outside the housing 1.

All the pumps described above can be adapted in such a way that their direction of rotation is reversed into the clockwise direction and their rotation speed can be adjusted to a desired value by changing the speed of the electromotor or the roller vane production motor.

In a similar way as described for the motors, the shape of the rising and falling part of the wing deflector cams 5, the shape of the recesses 6 and the size of the rollers 7, related to the distance between the inner surface of the housing 1 and the outer surface of the rotor 2, may be optimised to ensure a smooth travel of rollers 7.

As in the motors, also in the pumps described above the number of wing deflector cams may be larger than two and the number of rollers may be larger or smaller than six.

Figure 12A:
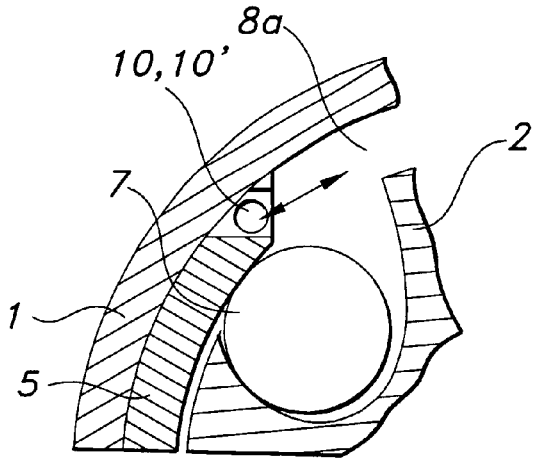
FIG. 12A is a transverse sectional view from above of parts of roller vane motors and roller vane pumps showing a continuous connection between the chambers.
Figure 12B:
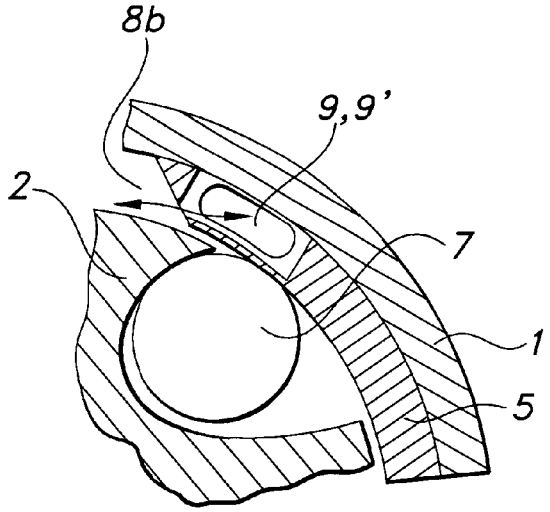
FIG. 12B is a transverse sectional view in accordance with FIG. 12A with the connection between the chambers widened.

In the motors and pumps that have been described in the FIGS. 1, 3, 4, 8, 9, 10 and 11 the inlet and/or outlet ports 9, 9', 10, 10' debouch into the chambers 8*a, b* at or near the rising/falling part of the wing deflector cams 5. This has the disadvantage that the upper or lower side of the rollers 7 temporarily block these ports during rotation of the rotor 2, as a result of which the discharge/supply of drilling mud temporarily stops. This can be remedied by locating these ports partly or wholly behind the edge of the rising/falling part of the wing deflector cams 5. To maintain a continuous connection with the chambers 8*a, b* (part of) the rising/falling part must be shortened lengthwise at the side concerned. This embodiment is shown schematically in FIG. 12A for an inlet/outlet port 10, 10'. Each connection can be widened by creating additional space behind the inside edge of the concentric part of the wing deflector cams 5. This is schematically shown in FIG. 12B for an inlet/outlet port 9, 9'.

An analysis of the rotation process shows that vibration problems and stalling of the rotor may occur as a result of hydraulic phenomena both in the roller vane motors and roller vane pumps according to the invention. When rollers mount the rising part or run down the falling part of wing deflector cams, the volume between these rollers and preceding and following rollers changes. To prevent the occurrence of too high pressures between succeeding rollers, the space between these rollers must be continuously in connection with other liquid-filled spaces in the motor or pump when a roller is travelling on a rising or falling part of a wing deflector cam.

Figure 13A:
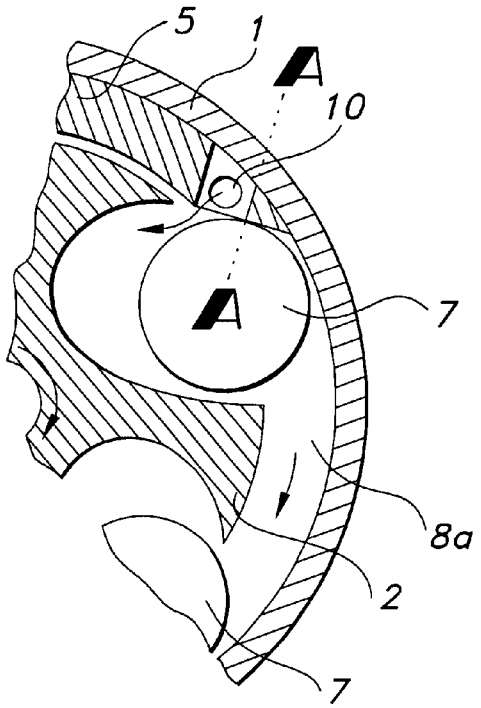
FIG. 13A is a transverse sectional view from above of a roller vane motor illustrating the position of a roller that has descended from the falling part of the wing deflector cam.

FIG. 13A shows a roller 7 that has descended from the falling part of a wing deflector cam 5 and has just reached the inside surface of the housing 1. At that moment, the volume of the chamber part 8*a* between this roller and the preceding roller 7 on the inside of the housing 1 does not decrease anymore, so that the connection with the inlet port 10 on said falling part can be restricted to the dotted line A—A.

Figure 13B:
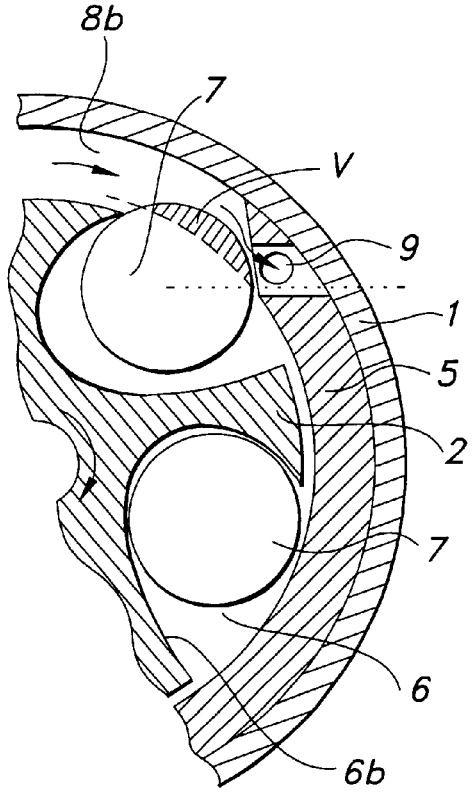
FIG. 13B is a transverse sectional view from above of a roller vane motor illustrating the position of a roller that is at the end of its rise on the rising part of the wing deflector cam.
Figure 14A:
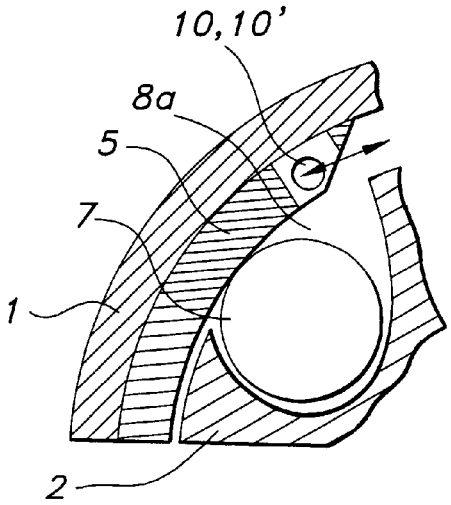
FIG. 14A is a transverse sectional view from above of parts of roller vane motors and roller vane pumps showing a shortening of the rising/falling part of a wing deflector cam in order to make connection between inlet and outlet ports.

FIG. 13B shows a roller 7 at the end of its rise on the rising part of a wing deflector cam 5. Further rotation of the rotor 2 will tilt this roller 7 onto the concentric section of the wing deflector cam 5. While this happens, the volume between this roller 7 and the preceding roller on the concentric part of the wing deflector cam 5 decreases by V. Because a connection as been established between this space and the outlet port 9 via a small adjacent concentric part of the wing deflector cam 5, this volume can escape to the outlet port 9. Should this connection have been restricted to the rising part of the wing deflector cam 5, then the roller 7, which is travelling on the concentric part of the wing deflector cam 5, would have been pressed against the downstream side 6*b* of its recess 6, after which the rotor 2 would have come to a standstill as a result of the rapidly increasing pressure between both rollers. Thus, the shortening of the rising/falling part of a wing deflector cam 5, in order to make connection with inlet/outlet ports 10, 10', 11, 11', does not have to occupy the full width of said rising/falling part but must be extended to the nearby concentric part of this wing deflector cam 5, as shown in FIG. 14A for an inlet/outlet port 10, 10'.

Figure 14B:
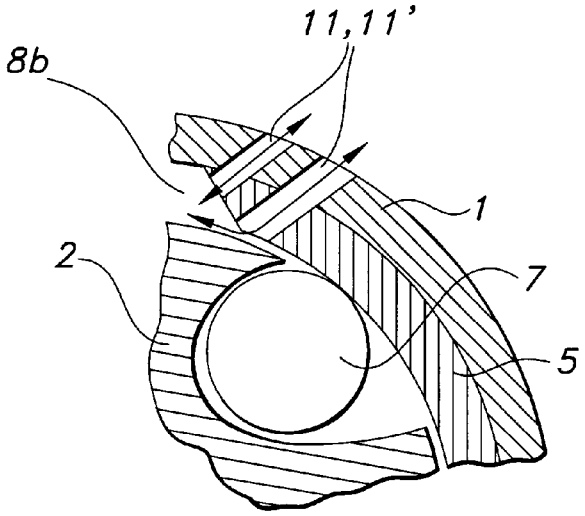
FIG. 14B is a transverse sectional view from above of parts of roller vane motors and roller vane pumps showing the splitting of each port into two ports.

With inlet/outlet ports 11, 11', 17 in the housing 1, the solution of problems with high/low pressure between rollers consists of widening these inlet/outlet ports 11, 11', 17 such that they occupy a sufficiently wide section of the rising/falling part of a wing deflector cam 5, in addition to a small part of its nearby concentric part. Alternatively, each port can be split up into two ports, that cover both sides of such a wide port. This solution is schematically shown for inlet/outlet ports 11, 11', in FIG. 14B.

It will be appreciated that other solutions are possible to solve the problems of too high/low pressure in roller vane motors or pumps. With inlet/outlet ports at or near the rising/falling part of a wing deflector cam 5 a solution consists for instance in making one or more grooves in the rising/falling part of these wing deflector cams 5.

In roller vane motors or pumps with inlet/outlet ports 14, 14' in the rotor 2 the above-mentioned provisions do not have to be made. In these motors and pumps, the spaces between rollers 7 are at all times connected with other liquid-filled spaces in the motor or pump by way of said inlet/outlet ports 14, 14'.

Motors and pumps according to the present invention may be used for various purposes with various fluids. The drilling motors are not only suitable for drilling and coring but also for well cleaning/repairing and the present invention includes within its scope drilling, coring and cleaning/repairing apparatus wherein motors of the present invention are used, as well as methods of driving drilling, coring and cleaning/repairing apparatus using motors of the present invention.

The production motor and pumps are not only suitable for oil-field use but can also be used for producing drinking water, for producing hot water in geothermal projects, or for producing drain water in mining operations such as for instance surface brown coal mining. They can also be employed in fire-fighting and cooling water installations on offshore platforms using seawater.

The invention includes within its scope therefore both oil and water production installations in which motors and/or pumps of the present invention are used as well as methods to produce water from a subterranean reservoir to the ground surface or to pump up water from a surface water reservoir using a motor and/or pump of the present invention.

What is claimed is:

1. A roller vane motor for drilling or coring, driven by mud, comprising a tubular housing with axial ends located at opposite sides, there being in between an imaginary principal axis, and a rotor that rotates around this principal axis in a rotor space inside the housing, with an annular space between the rotor and the inner wall of the housing, said housing being provided with a plurality of inwardly projecting wing deflector cams that divide the annular space between the rotor and the inner wall of the housing into chambers, each wing deflector cam having a rising part, a concentric part and a falling part, said rotor being provided with a plurality of recesses located along the circumference of said rotor and extending substantially parallel to the principal axis, each recess having a cylindrical roller that is displaceable from an extended position, in which the roller is in contact with the inner wall of the housing between wing deflector cams, to a retracted position, in which the roller is in contact with a wing deflector cam, said roller dividing the chambers into a high-pressure chamber part and a lower-pressure chamber part, each wing deflector cam having a rising part that runs inward from the inner wall of the housing and forces a passing roller from its extended position into its retracted position, and a falling part that runs outward towards the inner wall of the housing and allows a passing roller to move from its retracted position towards its extended position, wherein the housing at one of its axial ends has a first bearing part for the rotor, and wherein the housing at its other axial end has a second bearing part for the rotor, which bearing parts determine the axial ends of the rotor space, the first bearing part near the falling part of each wing deflector cam being provided with one or more inlet ports, and the second bearing part near the rising part of each wing deflector cam being provided with one or more outlet ports, so that mud passes through said chambers in the axial direction from the inlet port in said first bearing part to the outlet ports in said second bearing part.

2. A roller vane motor as claimed in claim 1, wherein the rotor is provided with a central conduit that is separated from the rotor space and runs the length of the rotor to provide a passage for the driving fluid between the axial ends of the housing.

* * * * *